US007413257B2

(12) United States Patent
Ojanen

(10) Patent No.: US 7,413,257 B2
(45) Date of Patent: Aug. 19, 2008

(54) ROTATABLE CUTTING TOOL WITH REVERSE TAPERED BODY

(75) Inventor: Randall W. Ojanen, Bristol, TN (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 11/258,969

(22) Filed: Oct. 26, 2005

(65) Prior Publication Data

US 2007/0090679 A1 Apr. 26, 2007

(51) Int. Cl.
*E21C 35/18* (2006.01)

(52) U.S. Cl. ..... 299/110

(58) Field of Classification Search ..... 299/102–107, 299/110–111, 113

See application file for complete search history.

(56) References Cited

U.S. PATENT DOCUMENTS

| | | | | | |
|---|---|---|---|---|---|
| 4,159,746 | A | | 7/1979 | Wrulich et al. | |
| 4,485,655 | A | | 12/1984 | Ewing | |
| 4,502,734 | A | * | 3/1985 | Allan | 299/101 |
| 4,627,665 | A | | 12/1986 | Ewing et al. | |
| 4,850,649 | A | | 7/1989 | Beach | |
| 4,886,710 | A | | 12/1989 | Greenfield | |
| 5,078,219 | A | * | 1/1992 | Morrell et al. | 299/111 |
| 5,141,289 | A | | 8/1992 | Stiffler | |
| 5,297,643 | A | | 3/1994 | Montgomery, Jr. et al. | |
| 5,324,098 | A | | 6/1994 | Massa et al. | |
| 5,456,522 | A | * | 10/1995 | Beach | 299/113 |
| 5,529,384 | A | | 6/1996 | Ojanen et al. | |
| 5,645,323 | A | * | 7/1997 | Beach | 299/111 |
| 6,312,529 | B1 | | 11/2001 | Leap et al. | |
| 6,397,652 | B1 | | 6/2002 | Sollami | |
| 6,601,620 | B1 | * | 8/2003 | Monyak et al. | 144/24.12 |
| 6,824,225 | B2 | | 11/2004 | Stiffler | |
| 6,851,758 | B2 | | 2/2005 | Beach | |
| 2006/0238016 | A1 | * | 10/2006 | Ritchey | 299/107 |

FOREIGN PATENT DOCUMENTS

| | | | |
|---|---|---|---|
| DE | 10163717 C1 | * | 5/2003 |
| FR | 2 815 999 A1 | | 5/2002 |
| FR | 2815999 A1 | * | 5/2002 |

OTHER PUBLICATIONS

Cummins, Arthur, SME Mining Engineering Handbook vol. 1, Illustration (Fig. 11-3) p. 11-4 (1973).

Internet Advertisement Printout Wirtgen Products (1 page) no date.

"Appendix C" Overhead Slide made for technical lecture to Virginia Tech Students, used each Fall from 1992-2003.

* cited by examiner

*Primary Examiner*—Sunil Singh
(74) *Attorney, Agent, or Firm*—Matthew W. Smith

(57) ABSTRACT

A rotatable cutting tool includes a cutting tool body that has an axial forward end and an axial rearward end. The cutting tool body further has an axial length. There is a hard tip, which has a distal end, affixed to the cutting tool body at the axial forward end thereof. The cutting tool body has a clearance portion axial rearward of the distal end of the hard tip wherein the clearance portion has a transverse dimension. The clearance portion includes an axial forward transverse dimension and a minimum transverse dimension that is axial rearward of the axial forward transverse dimension. The axial forward dimension is greater than the minimum transverse dimension. The clearance portion has an axial length equal to between about ten percent and about thirty-five percent of the axial length of the cutting tool body.

8 Claims, 9 Drawing Sheets

ROTATABLE CUTTING TOOL WITH REVERSE TAPERED BODY

BACKGROUND OF THE INVENTION

The invention pertains to a rotatable cutting tool that is useful for the impingement of earth strata such as, for example, asphaltic roadway material, coal deposits, mineral formations and the like. More specifically, the present invention pertains to a rotatable cutting tool that is useful for the impingement of earth strata wherein the cutting tool body possesses improved strength and design so as to provide for improved performance characteristics for the entire rotatable cutting tool.

Heretofore, rotatable cutting tools have been used to impinge earth strata such as, for example, asphaltic roadway material. Generally speaking, these kinds of rotatable cutting tools have an elongate cutting tool body typically made from steel and a hard tip (or insert) affixed to the cutting tool body at the axial forward end thereof. The hard tip is typically made from a hard material such as, for example, cemented (cobalt) tungsten carbide. The rotatable cutting tool is rotatably retained or held in the bore of a tool holder or, in the alternative, in the bore of a sleeve that is in turn held in the bore of a holder.

The holder is affixed to a driven member such as, for example, a driven drum of a road planing machine. In some designs, the driven member (e.g., drum) carries hundreds of holders wherein each holder carries a rotatable cutting tool. Hence, the driven member may carry hundreds of rotatable cutting tools. The driven member is driven (e.g., rotated) in such a fashion so that the hard tip of each one of the rotatable cutting tools impinges or impacts the earth strata (e.g., asphaltic roadway material) thereby fracturing and breaking up the material into debris.

Especially in a road planning operation in which the rotatable cutting tools impinge an asphaltic kind of material, the so-called breakout angle (or which is sometimes referred to as a fracture angle) is smaller in comparison to other kinds of more brittle material such as, for example coal. In this regard, one can define the breakout angle as the included angle between the central longitudinal axis of the rotatable cutting tool and a plane that generally lies on the fracture surface of the chip or fragment.

When impinging materials like asphaltic material in which there is a smaller breakout angle, there occurs an increase in the extent of contact between the rotatable cutting tool, and in particular the cutting tool body, and the asphaltic material. There are at least two occurrences that result from this increase in side contact.

One such occurrence is that this increase in contact creates more resistance to the movement of the rotatable cutting tool through the asphaltic material so as to thereby require an increase in the horsepower of the driven drum. Although one can increase the horsepower of a driven drum, such an increase adds to the cost of the machine itself, as well as to the cost to operate the road planing machine. It thus becomes apparent that it would be very desirable to provide an improved rotatable cutting tool that can be used for the impingement of earth strata wherein an increase in the horsepower of the driven drum is not necessary to satisfactorily operate for the impingement of material in which there is a smaller breakout angle. Along this same line, it would be desirable to provide an improved rotatable cutting tool that is of such a design so as to reduce the degree of resistance experienced by a rotatable cutting tool in impinging earth strata, and especially for a rotatable cutting tool when it impinges materials like asphaltic material, halite, gypsum, potash or trona in which there is a smaller breakout angle.

Another such occurrence is that this increase in contact creates more abrasive wear of the rotatable cutting tool and especially abrasive wear of the steel cutting tool body. The location of this wear on the steel cutting tool can sometimes be near the axial forward end thereof so as to jeopardize the integrity of the braze joint between the hard tip and the steel cutting tool body. The premature failure of the braze joint between the hard tip and the tool body typically leads to the loss of the hard tip which effectively ends the useful life of the rotatable cutting tool. The loss of the hard tip also typically results in a decrease in the overall operational efficiency of the road planing machine.

It thus becomes apparent that it would be very desirable to provide an improved rotatable cutting tool that has a cutting tool body of such a design so as to reduce the extent of abrasive wear of the cutting tool body during operation, and especially reduce the extent of abrasive wear of the cutting tool body when impinging materials like asphaltic materials that exhibit a smaller breakout angle. It also becomes apparent that it would be very desirable to provide an improved rotatable cutting tool that has a cutting tool body of such a design so as to improve or increase the protection of the braze joint between the hard tip and the cutting tool body during operation, and especially to improve or increase the protection of the braze joint between the hard tip and the cutting tool body when impinging materials like asphaltic materials that exhibit a smaller breakout angle.

In addition to the abrasive wear experienced by a rotatable cutting tool (and especially the cutting tool body) during a road planing application (or other applications in which the rotatable cutting tool impinges earth strata), there is a considerable amount of stress exerted on the rotatable cutting tool including the cutting tool body. If the cutting tool body does not exhibit sufficient strength then there is the risk that the cutting tool body may prematurely fail. Such a premature failure of the cutting tool body is an undesirable result that typically leads to the termination of the useful life of the rotatable cutting tool and a decrease in the operational efficiency of the machine such as a road planing machine. It would thus be very desirable to provide an improved rotatable cutting tool that has a cutting tool body of improved strength so as to reduce the potential for premature failure of the cutting tool body.

SUMMARY OF THE INVENTION

In one form thereof, the invention is a rotatable cutting tool that includes a cutting tool body that has an axial forward end and an axial rearward end. The cutting tool body further has an axial length. There is a hard tip, which has a distal end, affixed to the cutting tool body at the axial forward end thereof. The cutting tool body has a clearance portion axial rearward of the distal end of the hard tip wherein the clearance portion has a transverse dimension. The clearance portion includes an axial forward transverse dimension and a minimum transverse dimension that is axial rearward of the axial forward transverse dimension. The axial forward dimension is greater than the minimum transverse dimension. The clearance portion has an axial length equal to between about ten percent and about thirty-five percent of the axial length of the cutting tool body.

In one form thereof, the invention is a rotatable cutting tool that comprises a cutting tool body that has an axial forward end and an axial rearward end. The cutting tool body has an axial length. There is a hard tip that is affixed to the cutting tool body at the axial forward end thereof. The cutting tool body comprises a mediate portion and a clearance portion axial forward of the mediate portion. The clearance portion has a transverse dimension. The transverse dimension of the clearance portion decreases in the axial rearward direction. The clearance portion has an axial length equal to between about ten percent and about thirty-five percent of the axial length of the cutting tool body.

In still another form thereof, the invention is a cutting tool body for use with a hard tip. The cutting tool body comprises an axial forward end and an axial rearward end. The cutting tool body has an axial length. The cutting tool body has a clearance portion that has a transverse dimension that includes an axial forward transverse dimension and a minimum transverse dimension, which is located axial rearward of the axial forward transverse dimension. The axial forward dimension is greater than a minimum transverse dimension. The clearance portion has an axial length equal to between about ten percent and about thirty-five percent of the axial length of the cutting tool body.

BRIEF DESCRIPTION OF THE DRAWINGS

The following is a brief description of the drawings that form a part of this patent application.

DETAILED DESCRIPTION OF THE INVENTION

Figure 1:
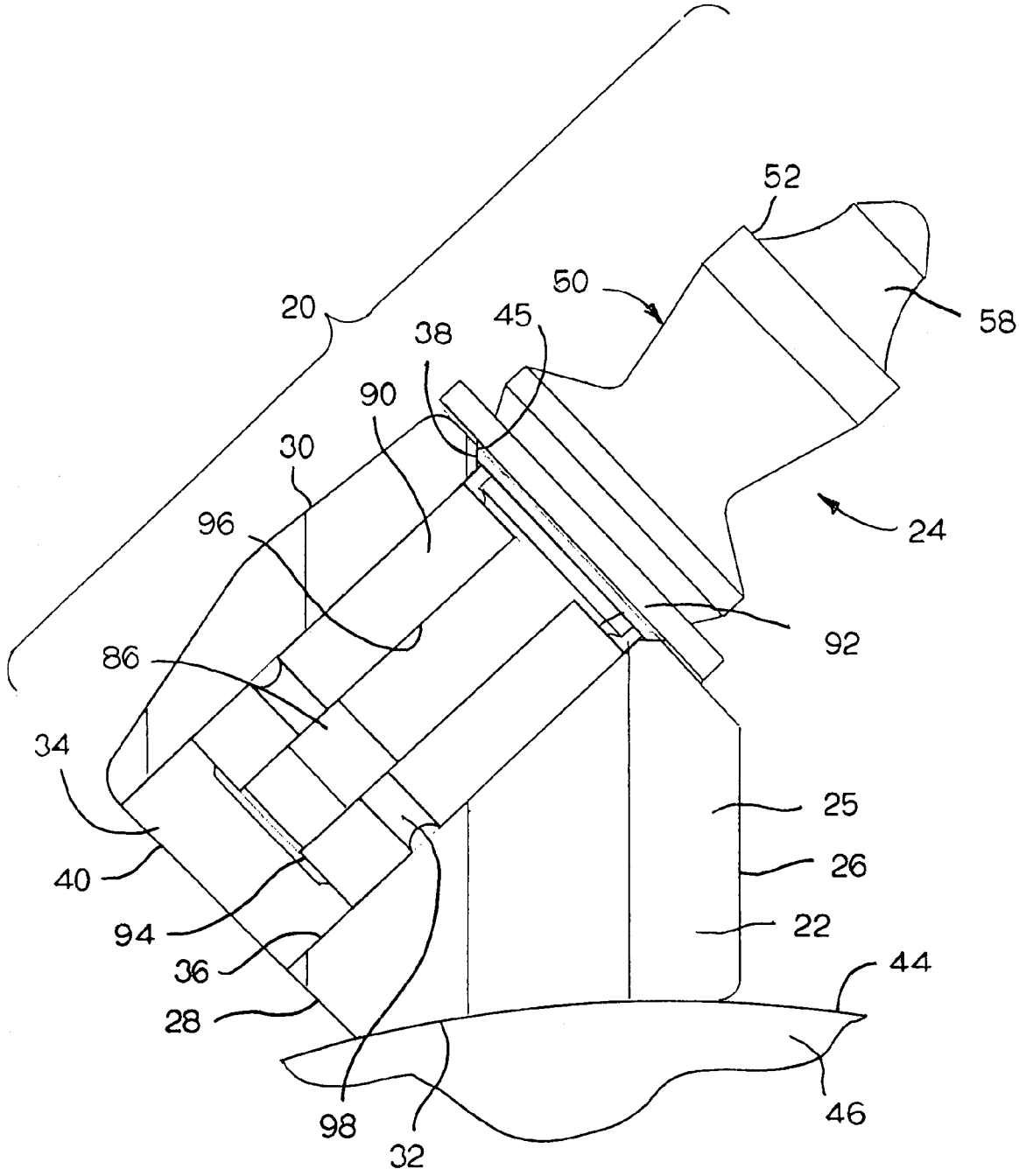
FIG. 1 is a side view of a specific embodiment of the rotatable cutting tool wherein the rotatable cutting tool is carried within the central bore of a tool holder (or block) that is, in turn, affixed to the surface of a driven member (e.g., a drum), and wherein the block is cut away so as to expose the axial rearward portion of the rotatable cutting tool within the bore of the holder.

Referring to the drawings, FIG. 1 is a side view of a specific embodiment of the rotatable cutting tool wherein the rotatable cutting tool is carried within the central bore of a tool holder (or block) that is in turn affixed to the surface of a driven member (e.g., a drum), and wherein the block is cut away so as to expose the axial rearward portion of the rotatable cutting tool within the bore of the holder. More specifically, the rotatable cutting tool assembly is designated by brackets 20 and comprises the holder (or block) 22 and the rotatable cutting tool generally designated as 24.

The holder 22 comprises a body 25 that has a forward surface 26, a rearward surface 28, a top surface 30 and a bottom surface 32. The holder 22 further includes a central longitudinal bore 34 that is defined by a generally cylindrical wall 36. The bore 34 includes an axial forward end 38 and an axial rearward end 40. There is a forty-five degree chamfer 45 at axial forward end 38 of the bore 34.

The holder 22 is affixed (such as by welding or the like) to the surface 44 of a driven member (e.g., the drum of a road planing machine) 46. In a road planing machine, typically there are plurality of holders 22 affixed to the surface 44 of the road planing drum 46 in a generally helical pattern or the like. In operation, the rotation of the drum 46 drives the rotatable cutting tools 24 into the earth strata (e.g., asphaltic material) so as to break up the material into pieces (i.e., debris).

Figure 5:
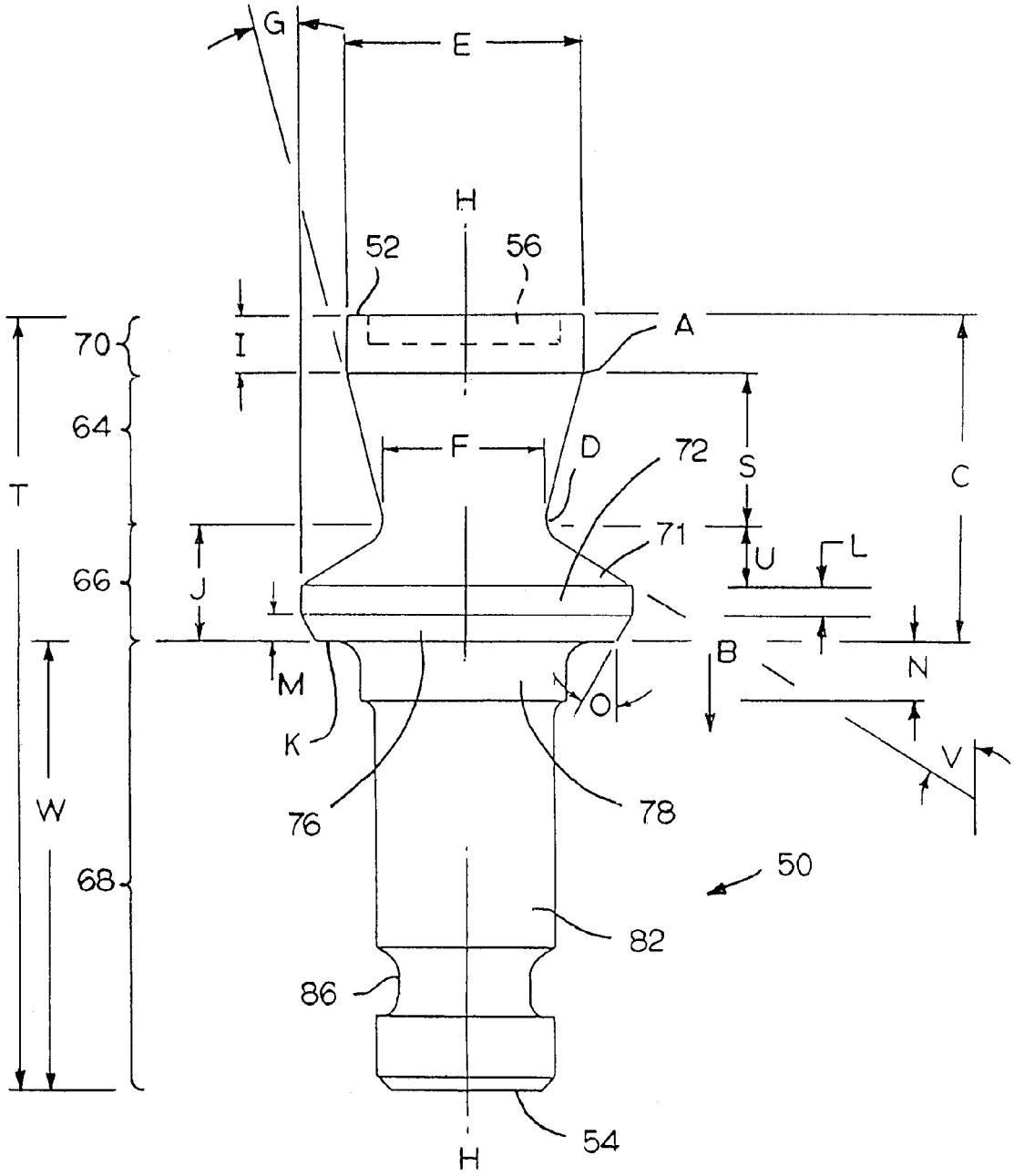
FIG. 5 is a side view of the cold formed steel cutting tool body of the specific embodiment of FIG. 1.

Referring to FIG. 5, the rotatable cutting tool 24 comprises a cold-formed elongate steel cutting tool body generally designated as 50. U.S. Pat. No. 4,886,710 to Greenfield, which is hereby incorporated by reference herein, discloses steel that is suitable for use for the cutting tool body 50.

The cutting tool body 50 has an axial forward end 52 and an axial rearward end 54. The cutting tool body 50 contains a socket 56 in the axial forward end 52 thereof. A hard tip 58 is received and affixed (such as by brazing) in the socket 56 and is affixed by brazing or the like to the cutting tool body 50 thereat. The hard tip 58 has a projection (not illustrated) that corresponds in shape to the socket 56 and is received therein as is well known in the art. The hard tip 58 has a distal end, i.e., the point at the axial forward termination.

It should be appreciated that in the alternative, the axial forward end of the cutting tool body may present a projection that is received within a socket in the bottom of the hard tip. This alternate structure can be along the lines of that disclosed in U.S. Pat. No. 5,141,289 to Stiffler wherein this patent is hereby incorporated by reference herein. Applicant points out that U.S. Pat. No. 5,141,289 also discloses braze alloys that typically are used to braze the hard tip to the socket in the cutting tool body.

Still referring in particular to FIG. 5, the cutting tool body 50 includes a clearance portion indicated by brackets 64, a mediate portion indicated by brackets 66 and a shank portion indicated by brackets 68. The clearance portion 64 is located near, but spaced a distance axial rearward of, the axial forward end 52 of the cutting tool body 50. The shank portion 68 is located at the axial rearward portion of the cutting tool body 50. The mediate portion 66 is located mediate of the clearance portion 64 and the shank portion 68.

Referring to the clearance portion 64, the clearance portion 64 begins at its axial forward boundary A, which is spaced axial rearward of the axial forward end 52 of the cutting tool body 50, and extends in the axial rearward direction (arrow B) a pre-selected distance S so as to terminate at its axial rearward boundary D. Clearance portion 64 has a transverse dimension along its entire axial length. In the case of this specific embodiment, the transverse dimension is a diameter since the cross-section is generally circular.

The clearance portion 64 has an axial forward transverse dimension E at the axial forward boundary A thereof. In this specific embodiment, the axial forward transverse dimension E is the maximum transverse dimension of the clearance portion 64. The clearance portion 64 has a minimum transverse dimension F at its axial rearward boundary D. In this specific embodiment, the minimum transverse dimension is the axial rearward transverse dimension.

As is apparent from the drawings and especially FIG. 5, the transverse dimension of the clearance portion 64 continually decreases from the axial forward transverse dimension E to the minimum transverse dimension F located at the axial rearward boundary D. As illustrated in the drawings, the nature of this decrease in transverse dimension is generally continual and at a generally uniform rate. However, it should be appreciate that the decrease may not be at a generally uniform rate, but the decrease in the transverse dimension may vary in rate. Further, as is apparent from the drawings, the axial forward transverse dimension E is greater than the minimum transverse dimension F.

The rotatable cutting tool 24 presents an axial gage body length C. The axial gage body length C is defined as the axial length of that portion of the cutting tool body as measured between the axial forward end 52 of the cutting tool body 50 and the axial rearward boundary of the mediate portion 66 (or the axial forward boundary of the shank portion 68) of the cutting tool body.

In this specific embodiment, the axial length S of the clearance portion 64 is equal to about one-half of the axial gage body length C of the cutting tool body 50. However, applicant expects that the S:C ratio could range between about 10:100 and about 75:100. As a narrower range, the S:C ratio could range between about 35:100 and about 55:100.

Further, in this specific embodiment, the ratio of the axial length S of the clearance portion 64 to the axial length T of the entire cutting tool body 50 is equal to about 20:100. However, applicant expects that the S:T ratio could range between about 10:100 and about 35:100. As a narrower range, the S:T ratio could range between about 20:100 and about 32:100.

Applicant believes that the axial length S of the clearance portion 64 as compared to the axial gage length C of the cutting tool body 50 and the axial length S of the clearance portion 64 as compared to the axial length T of the cutting tool body 50 should impact the performance of the rotatable cutting tool by, at a minimum, reducing the horsepower requirements for a road planing machine as compared to when such a machine used earlier rotatable cutting tools. As can be appreciated, a rotatable cutting tool that can reduce the horsepower requirements of the road planing machine provides an operational and economic advantage.

In this regard, the rotatable cutting tools used in road planing machines are often oriented at a side skew angle of between about five degrees to about ten degrees in order to improve the rotation of the cutting tool. However, even though the side skew results in an improvement in the rotation of the cutting tool, it also adds to the extent of side loading of the rotatable cutting tool. Thus, the existence of side clearance (or side relief) is especially important in a road (asphaltic material) planning application. It can be seen that a rotatable cutting tool with such side clearance provides an advantage over earlier tools because while earlier cutting tools provided for relief behind the cutting tool, they did not provide for relief to the side thereof.

As can be appreciated from the drawings, the clearance portion 64 presents a generally frusto-conical shape wherein the surface of the clearance portion 64 defines a clearance angle G. Clearance angle G is the angle between the surface of the clearance portion 64 and the central longitudinal axis H-H of the cutting tool body 50. In this specific embodiment, the clearance angle G is equal to about twenty (20) degrees. Clearance angle G can range between about fifteen (15) degrees and about thirty-five (35) degrees. As a narrower range, clearance angle G can range between about twenty (20) degrees and about twenty-five (25) degrees.

As an alternative, the clearance portion may begin at the axial forward end of the cutting tool body and extend in an axial rearward direction to its termination point (or axial rearward boundary). In such an alternate embodiment, the minimum transverse dimension exists at the axial rearward boundary of the clearance portion.

In the specific embodiment shown in the drawings, the cutting tool body 50 further includes a neck portion 70, which is of a generally cylindrical shape so as to exhibit a generally constant transverse dimension. The neck portion 70 begins at the axial forward end 52 of the cutting tool body 50 and extends for a pre-selected distance I in an axial rearward direction therefrom. The neck portion 70 is contiguous with the clearance portion 64 at the axial forward boundary A thereof.

The mediate portion 66 of the cutting tool body 50 is contiguous with the axial rearward boundary D of the clearance portion 64 and extends in an axial rearward direction for a pre-selected distance J therefrom. The mediate portion 66 terminates at its axial rearward boundary K.

The mediate portion 66 includes an axial forward frusto-conical section 71 that has an axial length U and is disposed at an angle V with respect to the central longitudinal axis H-H of the cutting tool body 50. Angle V is equal to about sixty (60) degrees.

The mediate portion 66 further includes a mediate cylindrical section 72. The mediate cylindrical section 72 extends in an axial rearward direction for a pre-selected distance L. The mediate portion 66 also includes a rearward frusto-conical section 76 that is contiguous with the mediate cylindrical section 72 and extends therefrom in an axial rearward direction for a pre-selected distance M. The axial rearward frusto-conical section 76 presents a surface that is disposed at an included angle O with respect to the central longitudinal axis H-H of the cutting tool body 50 that is equal to about eighteen (18) degrees. Included angle O can range between about eighteen (18) degrees and about forty-five (45) degrees.

The shank portion 68 extends from the axial rearward boundary of the mediate portion 66 in an axial rearward direction. The shank portion 68 presents an arcuate-cylindrical section 78 that is contiguous with the rearward frusto-conical section 76 and extends therefrom in an axial rearward direction for a pre-selected distance N. The rearward potion 68 further includes a cylindrical section 82 that is contiguous with the arcuate-cylindrical section 78 and extends in the axial rearward direction therefrom. The cylindrical section 82 contains an annular groove 86 therein. The shank portion 68 has an overall axial length W.

The rotatable cutting tool 24 further includes a resilient retainer 90 (see FIG. 1) that has an axial forward end 92 and an axial rearward end 94. A longitudinal slit 96 extends along the longitudinal length of the retainer 90. The retainer 90 further includes a radial inward projection 98.

As is illustrated in FIG. 1, the shank portion 68 of the cutting tool body 50 carries the retainer 90 in such a fashion that the radial inward projection 98 is received within the groove 86. Such an arrangement for a retainer is along the lines of the retainer shown and described in U.S. Pat. No. 4,850,649 to Beach, which is hereby incorporated by reference herein.

Figure 2:
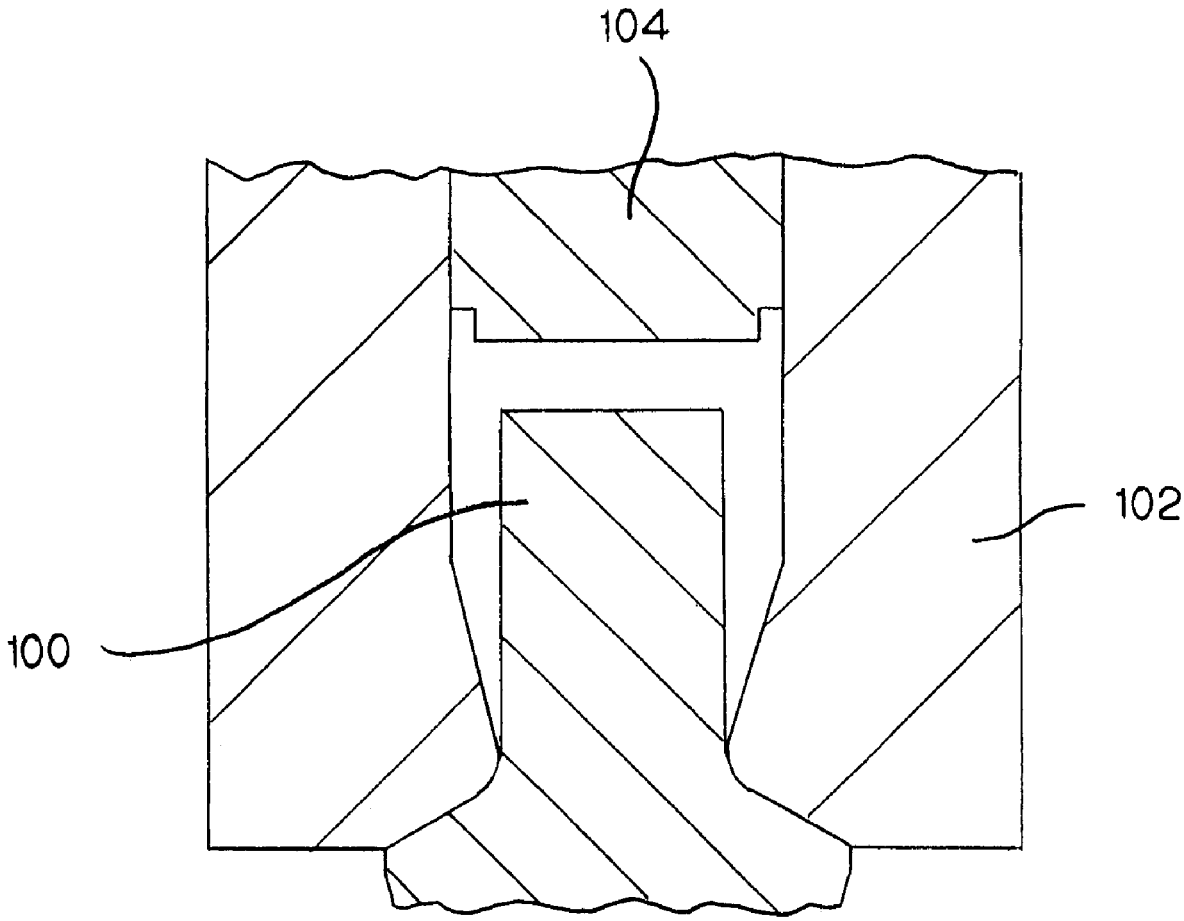
FIG. 2 is a mechanical schematic view of the steel blank, as well as the cold forming punch and segmented dies for the cold forming of the axial forward portion of the cutting tool body of the specific embodiment of the rotatable cutting tool illustrated in FIG. 1, and wherein the punch has not yet impacted the steel blank.
Figure 3:
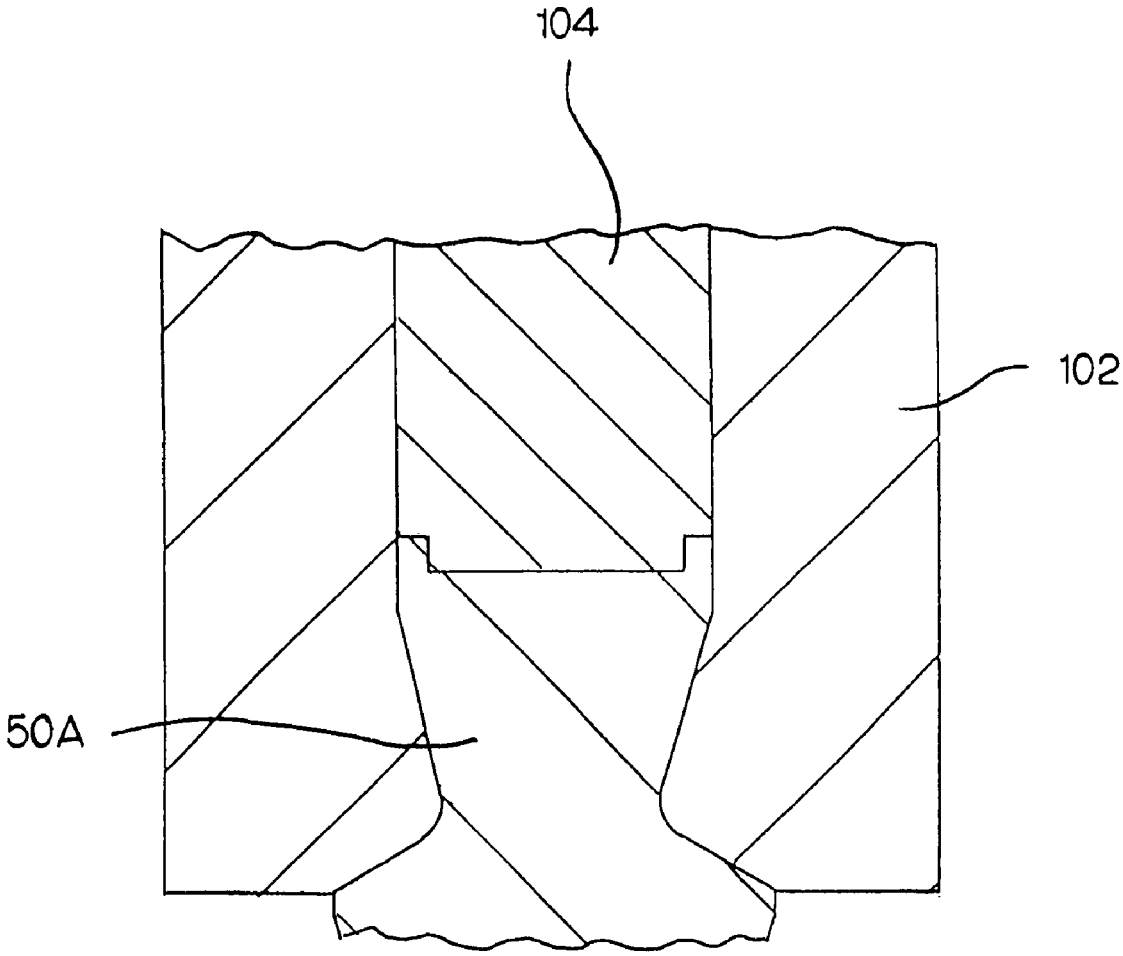
FIG. 3 is a schematic view of the steel blank, as well as the cold forming punch and segmented dies, wherein the cold forming process of the axial forward portion of the cutting tool body is complete.
Figure 4:
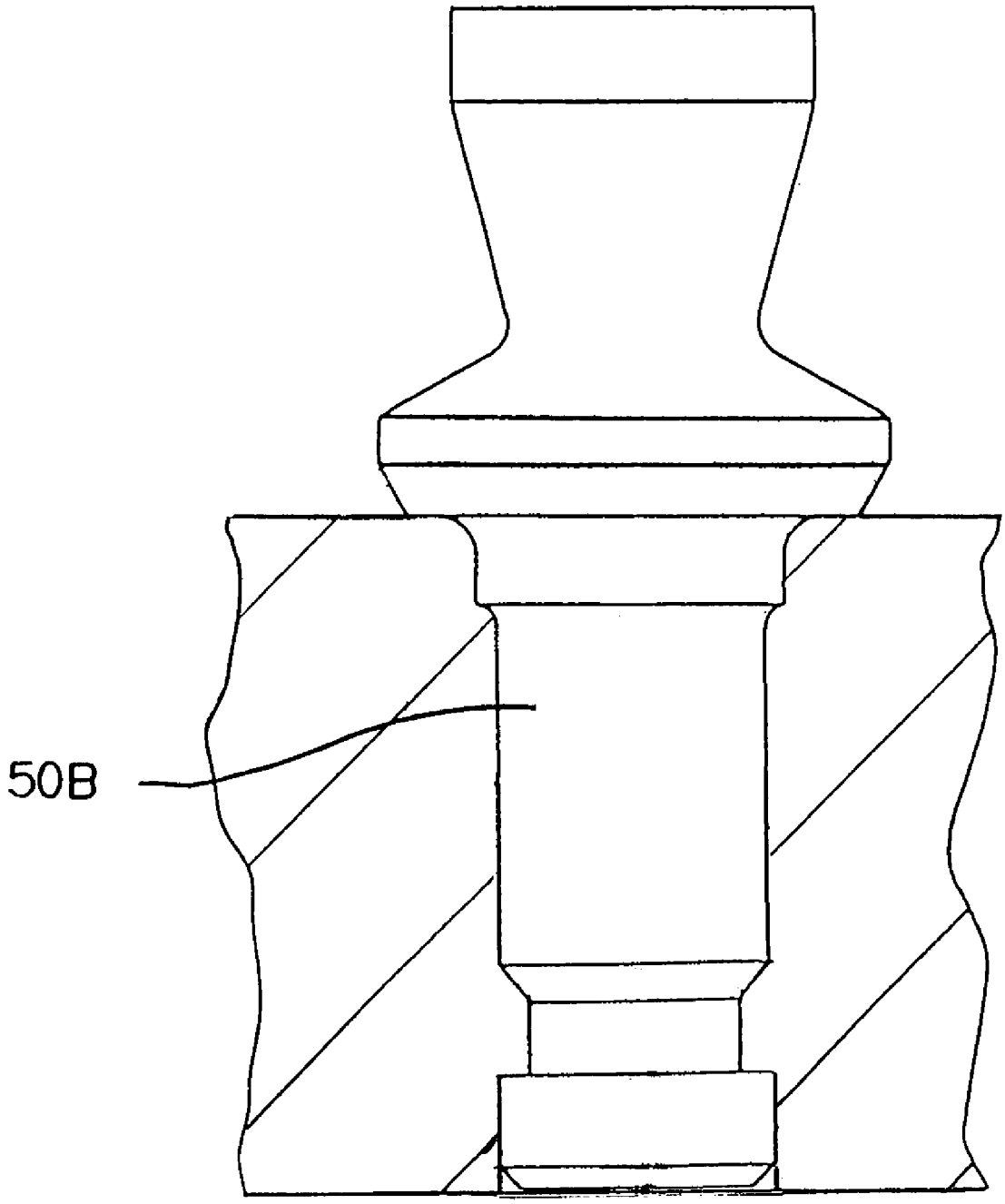
FIG. 4 is a schematic view of the steel blank, as well as the cold forming punch and segmented dies, wherein the cold forming process of the axial rearward portion of the cutting tool body is complete.

As shown in FIGS. 2 through 4, the cutting tool body 50 is made by a cold forming process. More specifically, as shown in FIG. 2, the cylindrical blank 100 is positioned with the segmented dies 102 with the punch 104 positioned so as to be in position to impact the blank 100. FIG. 3 shows the completion of the pressing operation for the formation of the axial forward portion of the cutting tool body (see 50A). FIG. 4 shows the completion of the pressing operation for the formation of the axial rearward portion of the cutting tool body (see 50B).

Figure 6:
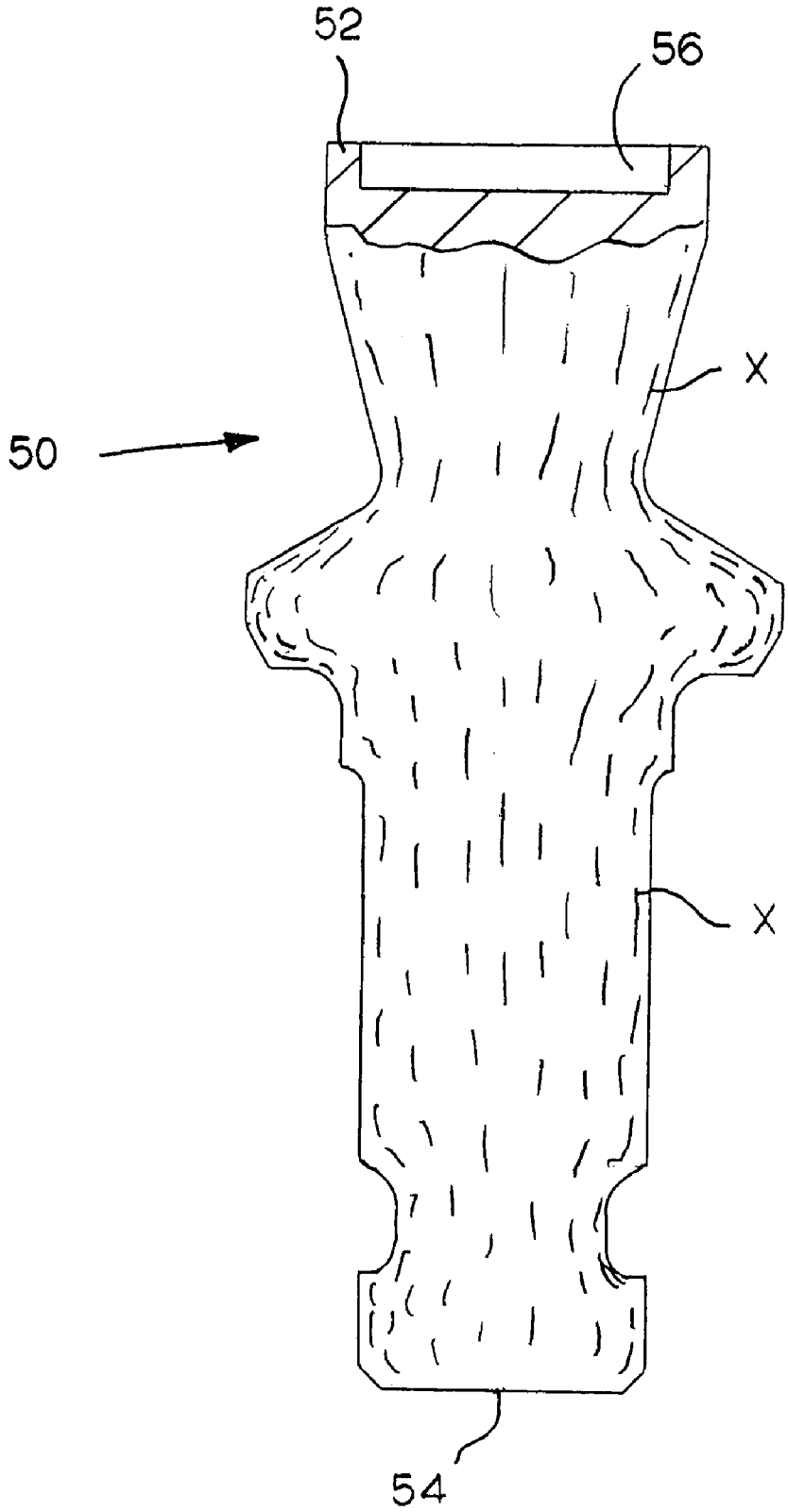
FIG. 6 is a side view of the cold formed steel cutting tool body of the specific embodiment of FIG. 1 showing the direction of the grain orientation of the steel body and with the axial forward portion broken away so as to show the socket that receives the hard tip.

FIG. 6 is a schematic view that shows the direction of orientation of the grain of the steel. As can be seen, the orientation of the direction of the grain of the steel is generally parallel (or generally corresponds with) the geometry of the peripheral surface of the cutting tool body 50. It should be appreciated that by orienting the direction of the grain of the steel the strength of the part, i.e., the cutting tool body, is increased as compared to a part in which there are machined portions so that the orientation of the grain does not correspond with the geometry of the surface of the part. In view of the forming process, the cutting tool body 50 can be considered to be a net-shaped body and when made out of steel, it is a net-shaped steel body.

Figure 7:
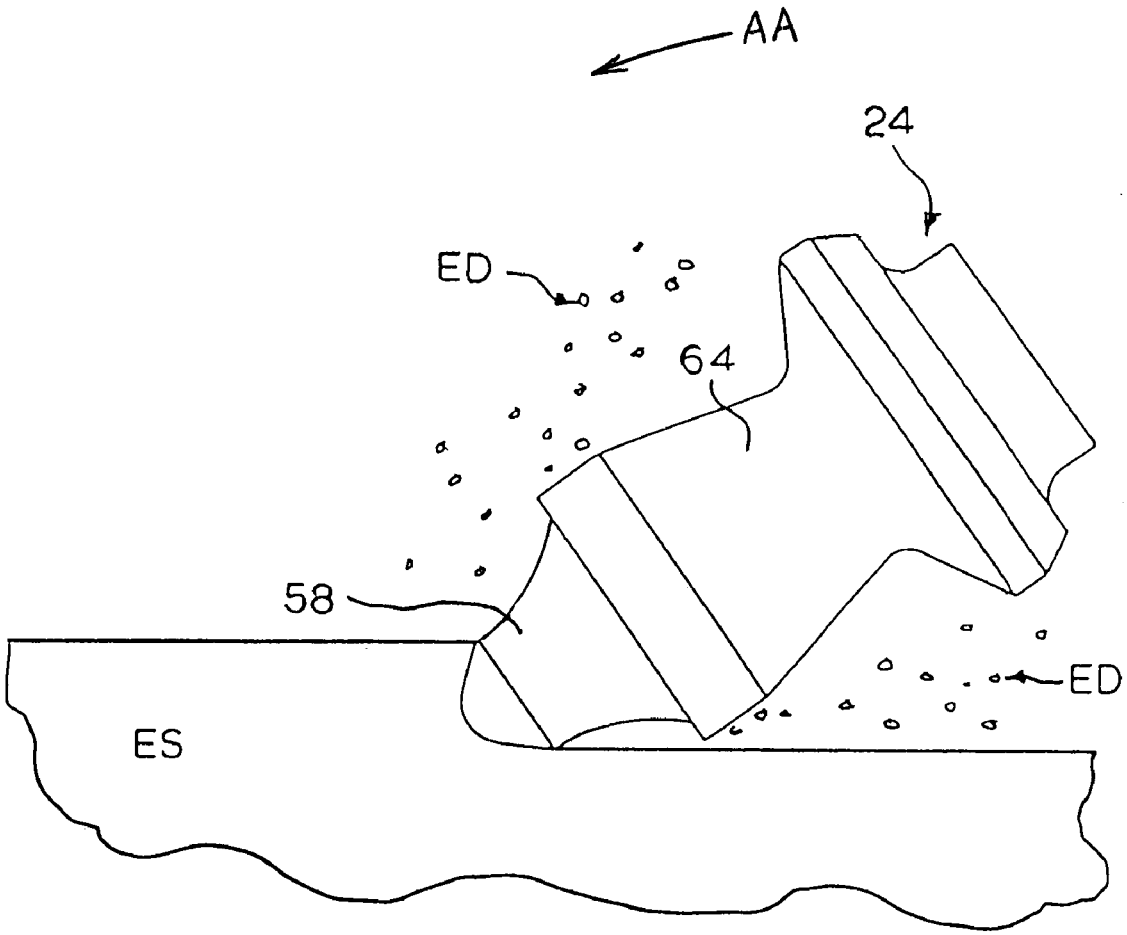
FIG. 7 is a mechanical schematic side view of the axial forward portion of the rotatable cutting tool impinging the asphaltic material (i.e., earth strata) that shows the movement of the debris from the location of the impingement of the rotatable cutting bit against the earth strata.

FIG. 7 is a mechanical schematic view that shows the movement of the debris from the impingement of the rotatable cutting bit 24 with the earth strata (ES). Arrow AA indicates the direction of rotation and impingement of the hard tip into the earth strata. While this drawing shows a particular depth of cut, it should be appreciated that the depth of the cut can vary (or be adjustable) depending upon the specific application and operating conditions.

It can be seen that a significant portion of the earth strata in the form of debris (ED) moves past the clearance portion of the rotatable cutting tool. By doing so, it does not cause abrasive wear of the tool body at this location. This is an advantage of the present rotatable cutting tool 24 as compared to a conventional rotatable cutting tool in which the debris abrades against the axial forward portion of the tool.

Figure 8:
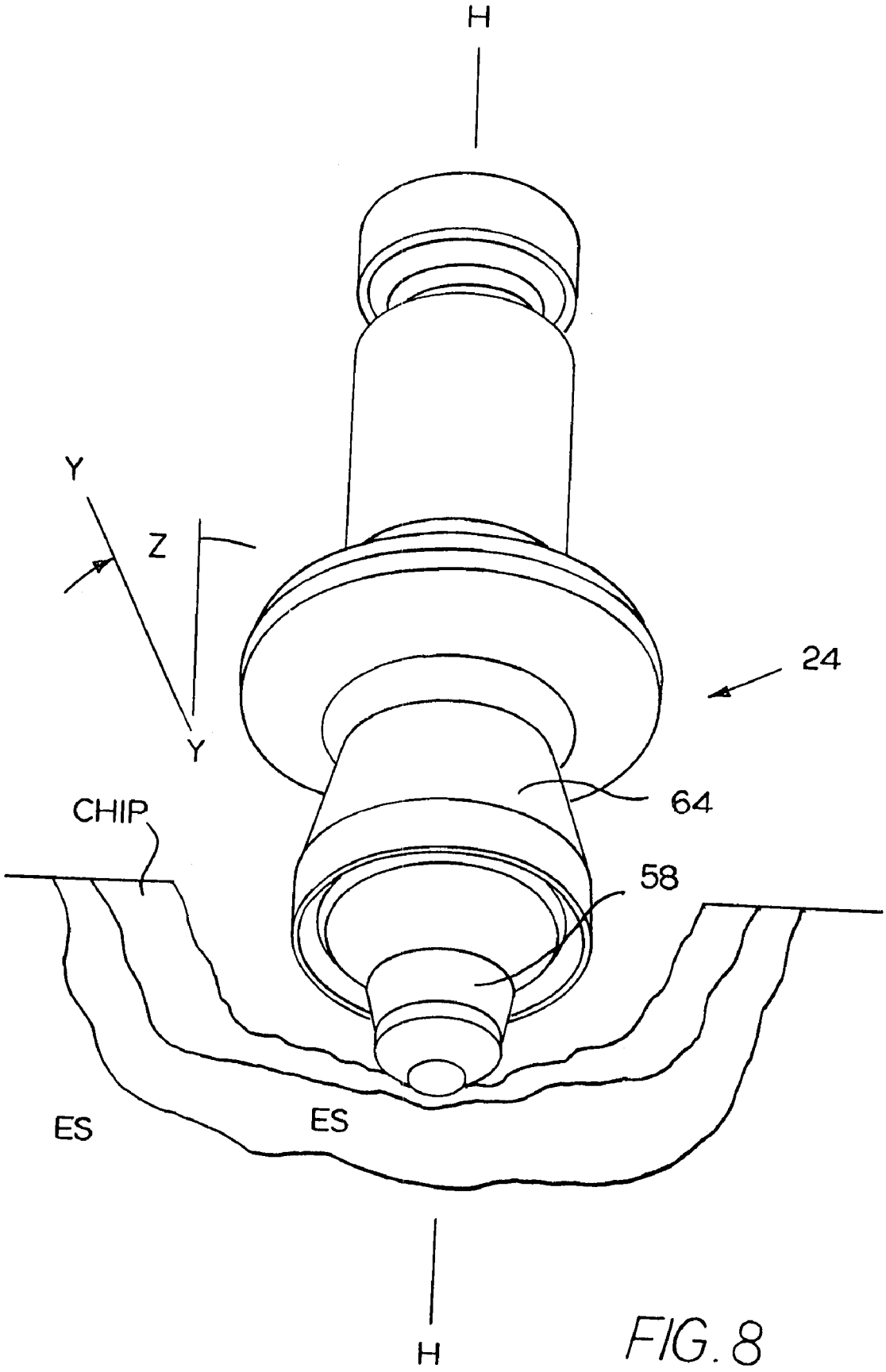
FIG. 8 is an isometric view of the rotatable cutting tool impinging the asphaltic material (i.e., earth strata) that shows the relationship between the rotatable cutting bit and the chip or fragment so as to define the breakout angle.

FIG. 8 is an isometric front view of the rotatable cutting tool 24 impinging the asphaltic material (i.e., earth strata) that shows the relationship between the rotatable cutting bit and the chip or fragment so as to define the breakout angle. More specifically, there is shown a CHIP, which is a fragment of the earth strata that has been broken or is about to be completely broken. The CHIP presents a fracture surface, which is the exposed surface of the CHIP. A plane Y-Y lies generally along the fracture surface. The breakout angle Z is the included angle between the longitudinal axis H-H of the rotatable cutting tool 24 and the plane Y-Y. In this arrangement, it should be appreciated that the orientation of the rotatable cutting tool is such so as to exhibit a skew angle equal to zero degrees.

Figure 9:
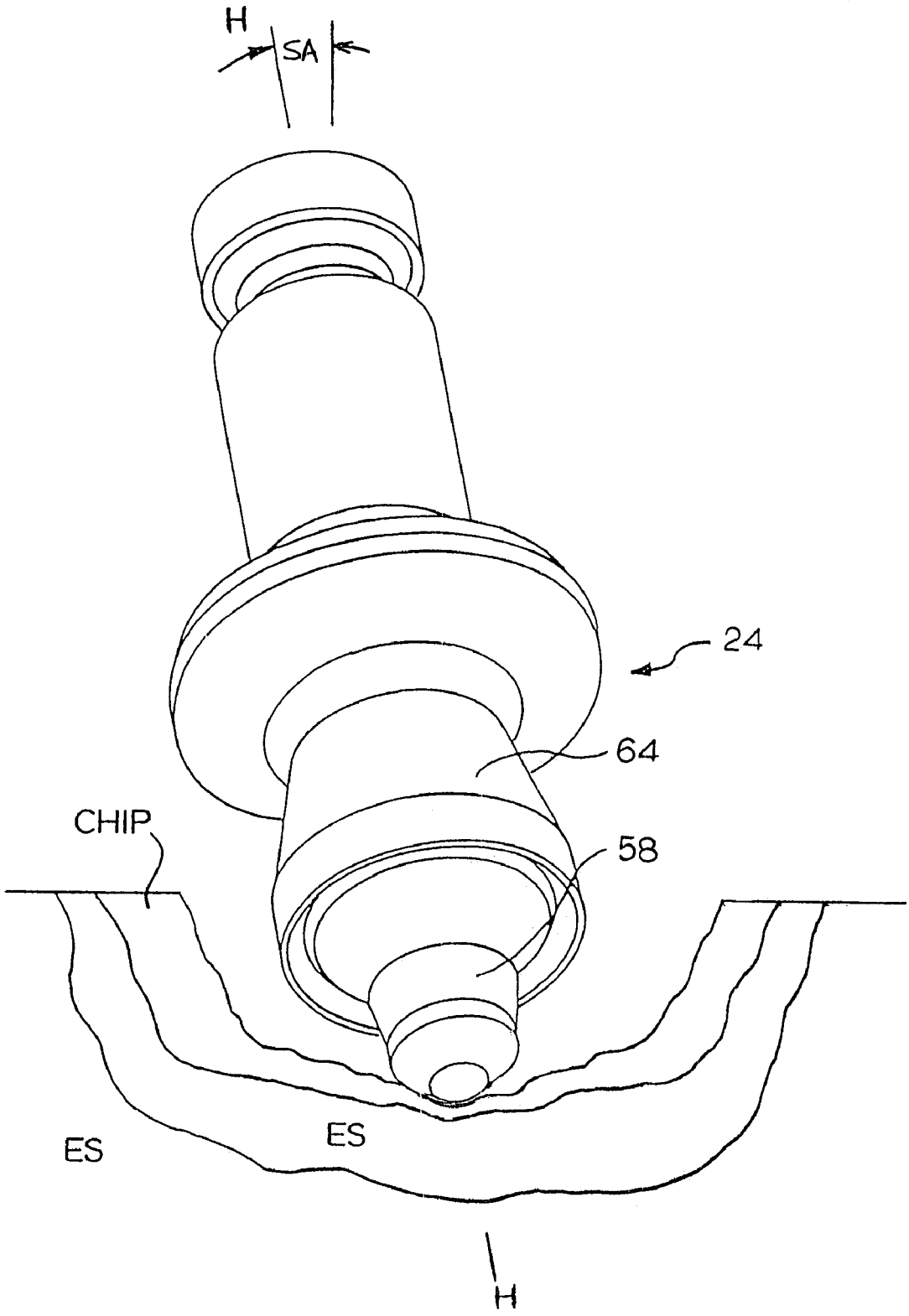
FIG. 9 is an isometric view of the rotatable cutting tool impinging the ashaltic material (i.e., earth strata) at a skew angle and which shows the relationship between the rotatable cutting bit and the chip or fragment.

FIG. 9 is an isometric front view of the rotatable cutting tool 24 impinging the asphaltic material (i.e., earth strata) that shows the relationship between the rotatable cutting bit and the chip or fragment. More specifically, there is shown a CHIP, which is a fragment of the earth strata that has been broken or is about to be completely broken. The CHIP presents a fracture surface, which is the exposed surface of the CHIP. The breakout angle would be essentially the same as shown in FIG. 8. In this arrangement, it should be appreciated that the orientation of the rotatable cutting tool is such so as to exhibit a skew angle SA equal to about ten degrees.

As mentioned hereinabove, when impinging materials like asphaltic material in which there is a smaller breakout angle, there occurs an increase in the extent of contact between the rotatable cutting tool, and in particular there is an increase between the axial forward portion of the cutting tool body, and the asphaltic material. Applicant believes that the axial length S of the clearance portion 64 as compared to the axial gage length C of the cutting tool body 50 and the axial length S of the clearance portion 64 as compared to the axial length T of the cutting tool body 50 should impact the performance of the rotatable cutting tool by, at a minimum, reducing the horsepower requirements for a road planing machine as compared to when such a machine used earlier rotatable cutting tools.

In this regard, the rotatable cutting tools used in road planing machines are often oriented at a side skew angle of between about five degrees to about ten degrees in order to improve the rotation of the cutting tool. However, even though the side skew results in an improvement in the rotation of the cutting tool, it also adds to the extent of side loading of the rotatable cutting tool. Thus, the existence of side clearance (or side relief) is especially important in a road (asphaltic material) planning application. It can be seen that a rotatable cutting tool with such side clearance provides an advantage over earlier tools because while earlier cutting tools provided for relief behind the cutting tool, they did not provide for relief to the side thereof.

One drawback to this increase in contact between the asphaltic material and the cutting tool body is that there is created more resistance to the movement of the rotatable cutting tool through the asphaltic material so as to thereby require an increase in the horsepower of the driven drum. It is apparent that the present invention provides a rotatable cutting tool that can be used for the impingement of earth strata wherein an increase in the horsepower of the driven drum is not necessary to satisfactorily operate for the impingement of material in which there is a smaller breakout angle. It is also apparent that the present invention provides a rotatable cutting tool that is of such a design so as to reduce the degree of resistance experienced by the rotatable cutting tool in impinging earth strata, and especially for the rotatable cutting tool when it impinges material like asphaltic material, halite, gypsum, potash or trona in which there is a smaller breakout angle.

Another drawback to the increase in contact between the material and the cutting tool body is the presence of more abrasive wear of the rotatable cutting tool, and especially abrasive wear of the steel cutting tool body. It is apparent that the present invention provides a rotatable cutting tool that has a cutting tool body of such a design so as to reduce the extent of abrasive wear of the cutting tool body during operation, and especially reduce the extent of abrasive wear of the cutting tool body when impinging materials like asphaltic materials that exhibit a smaller breakout angle. It also apparent that the present invention provides a improved rotatable cutting tool that has a cutting tool body of such a design so as to improve or increase the protection of the braze joint between the hard tip and the cutting tool body during operation, and especially to improve or increase the protection of the braze joint between the hard tip and the cutting tool body when impinging materials like asphaltic materials that exhibit a smaller breakout angle.

As mentioned above, in addition to the abrasive wear experienced by a rotatable cutting tool (and especially the cutting tool body) during a road planing application (or other applications in which the rotatable cutting tool impinges earth strata), there is a considerable amount of stress exerted on the rotatable cutting tool including the cutting tool body. It is apparent that the present cutting tool body exhibits improved strength so as to reduce the potential for premature failure of the cutting tool body. This strength is provided by the fact that the orientation of the grain of the steel body generally corresponds (or is generally parallel) to the geometry of the surface of the cutting tool body.

The patents and other documents identified herein are hereby incorporated by reference herein.

Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A rotatable cutting tool for use in a mining or road planing holder having a central bore, said rotatable cutting tool comprising:

a cutting tool body and a hard tip affixed to said cutting body, said cutting tool body having an axial forward end containing a socket and an axial rearward end, a cylindrical neck portion rearward of the forward end, a clearance portion axially rearward of the neck portion, a mediate portion axially rearward of the clearance portion, a shank portion axially rearward of the mediate portion and the cutting tool body having an axial length;

wherein said hard tip is affixed to said cutting tool body in said socket, wherein said clearance portion has an axial forward generally circular cross section having an axial forward diameter and an axial rearward generally circular cross section having an axial rearward diameter, said axial forward diameter being greater than the axial rearward diameter and the axial length of said clearance portion equal to between about ten percent to about thirty-five percent of the axial length of the cutting tool body, wherein said mediate portion has a forward frusto-conical section, and a cylindrical section axially rearward of said forward frusto-conical section;

wherein said mediate portion forward frusto-conical portion increases in diameter from adjacent said clearance portion to said mediate portion cylindrical section; and wherein only said shank portion of said cutting tool body is insertable into said central bore of said mining or road planning holder.

2. The rotatable cutting tool of claim 1 wherein the diameter of the clearance portion decreases at a uniform rate from the axial forward diameter to the axial rearward diameter.

3. The rotatable cutting tool of claim 2 wherein the clearance angle ranging between about twenty degrees and about twenty-five degrees.

4. The rotatable cutting tool of claim 1 wherein the clearance portion presents a generally frusto-conical shape so as to define a clearance angle, and the clearance angle ranging between about fifteen degrees and about thirty-five degrees.

5. The rotatable cutting tool of claim 1 wherein said mediate portion having an axial rearward boundary, and the cutting tool exhibiting a gage length defined between the axial forward end of the cutting tool body and the axial rearward boundary of the mediate portion; and the ratio of the axial length of the clearance portion to the gage length ranging between about 10:100 and about 75:100.

6. The rotatable cutting tool of claim 5 wherein the ratio of the axial length of the clearance portion to the gage length ranging between about 35:100 and about 55:100.

7. The rotatable cutting tool of claim 1 wherein the cutting tool body being made of steel and presenting a peripheral surface, and the cutting tool body having a grain orientation wherein the direction of the grain orientation generally corresponds to the contour of the peripheral surface of the cutting tool body.

8. The rotatable cutting tool of claim 1 wherein said shank portion is adapted to carry a resilient retainer.

* * * * *